US007948440B1

(12) United States Patent
Honda et al.

(10) Patent No.: US 7,948,440 B1
(45) Date of Patent: May 24, 2011

(54) HORIZONTALLY-POLARIZED OMNI-DIRECTIONAL ANTENNA

(75) Inventors: Royden M. Honda, Post Falls, ID (US); Raymond R. Johnson, Spokane Valley, WA (US)

(73) Assignee: LHC2 Inc., Liberty Lake, WA (US)

( * ) Notice: Subject to any disclaimer, the term of this patent is extended or adjusted under 35 U.S.C. 154(b) by 312 days.

(21) Appl. No.: 11/865,673

(22) Filed: Oct. 1, 2007

Related U.S. Application Data

(60) Provisional application No. 60/827,712, filed on Sep. 30, 2006.

(51) Int. Cl.
*H01Q 13/10* (2006.01)

(52) U.S. Cl. ..... 343/767; 343/715

(58) Field of Classification Search ..... 343/702, 343/715, 767
See application file for complete search history.

(56) References Cited

U.S. PATENT DOCUMENTS

| | | | | |
|---|---|---|---|---|
| 2,625,654 | A | 1/1953 | Alford | |
| 2,812,514 | A | 11/1957 | Smith | |
| 3,474,452 | A | 10/1969 | Bogner | |
| 3,555,552 | A | 1/1971 | Alford | |
| 3,618,114 | A | 11/1971 | Dietrich | |
| 3,665,479 | A | 5/1972 | Silliman | |
| 3,810,183 | A | 5/1974 | Krutsinger et al. | |
| 4,131,892 | A | 12/1978 | Munson et al. | |
| 4,204,212 | A | 5/1980 | Sindoris et al. | |
| 4,233,607 | A | 11/1980 | Sanford et al. | |
| 4,451,829 | A | 5/1984 | Stuckey, Jr. et al. | |
| 4,527,163 | A | 7/1985 | Stanton | |
| 4,613,868 | A | 9/1986 | Weiss | |
| 4,710,775 | A | 12/1987 | Coe | |
| 4,839,663 | A | 6/1989 | Kurtz | |
| 4,899,165 | A | 2/1990 | Schadler | |
| 4,907,008 | A | 3/1990 | Dienes | |
| 5,021,797 | A | 6/1991 | Dienes | |
| 5,105,199 | A | 4/1992 | Ukmar | |
| 5,426,439 | A | 6/1995 | Grossman | |
| 5,617,105 | A * | 4/1997 | Tsunekawa et al. | 343/702 |
| 5,870,061 | A * | 2/1999 | Casciola et al. | 343/771 |
| 5,955,997 | A | 9/1999 | Ho et al. | |
| 6,127,983 | A * | 10/2000 | Rivera et al. | 343/767 |
| 6,313,806 | B1 * | 11/2001 | Schadler | 343/767 |
| 6,414,647 | B1 | 7/2002 | Lee | |

(Continued)

FOREIGN PATENT DOCUMENTS

| | | |
|---|---|---|
| EP | 1959518(A2) | 8/2008 |

(Continued)

OTHER PUBLICATIONS

Brown, et al., "Circularly-Polarized Omnidirectional Antenna*" RCA Review, pp. 259-269, Jun. 1947.

(Continued)

*Primary Examiner* — Tan Ho
(74) *Attorney, Agent, or Firm* — Lee & Hayes, PLLC

(57) ABSTRACT

Example embodiments for antennas that can transceive signals in horizontally-polarized omni-directional manners are described. In an example embodiment, an antenna includes a tube forming a slot and a supporting structure on which one or more transmission lines and at least one ground are disposed. In another example embodiment, an antenna includes a horizontally-polarized antenna assembly including at least one slot aperture antenna and a vertically-polarized antenna part.

20 Claims, 11 Drawing Sheets

U.S. PATENT DOCUMENTS

| | | | |
|---|---|---|---|
| 6,567,053 | B1 | 5/2003 | Yablonovitch et al. |
| 6,593,892 | B2 | 7/2003 | Honda et al. |
| 6,897,822 | B2 | 5/2005 | Sparks et al. |
| 6,967,625 | B1 | 11/2005 | Honda |
| 6,995,725 | B1 | 2/2006 | Honda et al. |
| 7,256,750 | B1 | 8/2007 | Honda |
| 7,394,435 | B1 | 7/2008 | Hozouri |
| 2005/0012673 | A1 | 1/2005 | Parsche et al. |

FOREIGN PATENT DOCUMENTS

| | | |
|---|---|---|
| JP | 2001352210(A) | 12/2001 |
| WO | WO0249147(A2) | 6/2002 |
| WO | WO02065583(A1) | 8/2002 |

OTHER PUBLICATIONS

Carver, et al., "Microstrip Antenna Technology", IEEE Transactions on Antennas and Propagation, vol. AP-29, No. 1, Jan. 1981.

DeJean, Design of Compact Antennas in Multilayer Technology for Wireless Communications / WLAN Applications, A Thesis Presented to the Academic Faculty, Georgia Institute of Technology, Dec. 2, 2004.

Krall, et al., "The Omni Microstrip Antenna: A new Small Antenna", IEEE Transactions on Antennas and Propagation, vol. AP-27, No. 6, Nov. 1979.

Munson, "Conformal Microstrip Antennas and Microstrip Phased Arrays", IEEE Transactions on Antennas and Propagation, Jan. 1974.

* cited by examiner

HORIZONTALLY-POLARIZED OMNI-DIRECTIONAL ANTENNA

CROSS-REFERENCE TO RELATED APPLICATIONS

The instant U.S. Nonprovisional Patent Application claims the benefit of co-pending U.S. Provisional Patent Application No. 60/827,712, filed on 30 Sep. 2006 by inventors Royden M. Honda and Raymond R. Johnson and entitled "Horizontal Polarized Omni-Directional Antenna". U.S. Provisional Patent Application No. 60/827,712 is hereby incorporated by reference in its entirety.

BACKGROUND

Wireless communication has become an integral part of modern life in both the personal and professional realms. It is used for voice, data, and other types of communication. Wireless communication is also used in military and emergency response applications. Communications that are made wirelessly rely on the electromagnetic spectrum as the carrier medium. Unfortunately, the electromagnetic spectrum is a limited resource.

Although the electromagnetic spectrum spans a wide range of frequencies, only certain frequency bands are applicable for certain uses due to their physical nature and/or due to governmental restrictions. Moreover, the use of the electromagnetic spectrum for wireless communications is so pervasive that many, if not most, frequency bands are already extraordinarily crowded. This crowding causes interference between and among different wireless communications.

Such interference jeopardizes the successful transmission and reception of wireless communications. Wireless communication interference can necessitate retransmissions, cause the use of ever greater power outlays, or even completely prevent wireless communications. Consequently, there is a need to reduce electromagnetic interference that may hinder the successful wireless communication of information, which is now important to many different aspects of modern society.

SUMMARY

Example embodiments for antennas that can transceive signals in horizontally-polarized omni-directional manners are described. In an example embodiment, an antenna includes a tube forming a slot and a supporting structure on which one or more transmission lines and at least one ground are disposed. In another example embodiment, an antenna includes a horizontally-polarized antenna assembly including at least one slot aperture antenna and a vertically-polarized antenna part.

Moreover, other antennas, systems, apparatuses, methods, devices, arrangements, mechanisms, approaches, etc. embodiments are described herein.

BRIEF DESCRIPTION OF THE DRAWINGS

The same numbers are used throughout the drawings to reference like and/or corresponding aspects, features, and components.

DETAILED DESCRIPTION

Introduction

Figure 1:
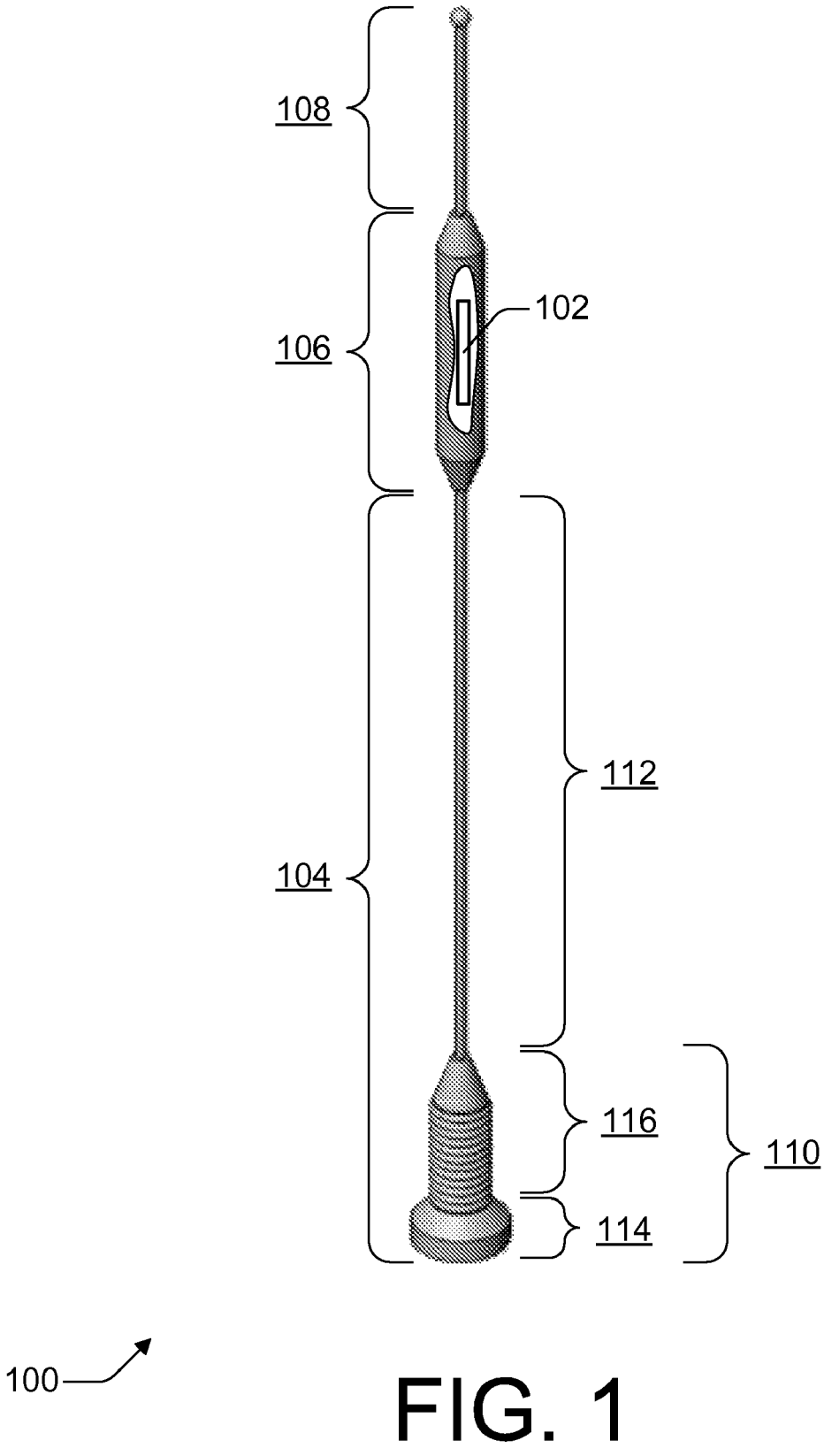
FIG. 1 depicts an example of a horizontally-polarized omni-directional antenna that includes an antenna assembly to transceive electromagnetic signals with a horizontal polarization.

There is a need to reduce electromagnetic interference that may hinder the successful wireless communication of information that is important to many different aspects of modern society. Interference between two wireless communications can be reduced by communicating wirelessly at different times and/or at different frequencies, by employing different codes, by using directional beamforming or other geographical separation strategies, and so forth. Interference can also be reduced by transmitting and/or receiving (e.g., transceiving) with different orthogonality to the electromagnetic carrier media.

For example, an antenna that is horizontally-polarized typically has substantially less interference with vertically-polarized antennas as compared to with other horizontally-polarized antennas. This is ordinarily true even after accounting for reflections and other events that can affect the physical nature (e.g., directionality, orthogonality, etc.) of a propagating electromagnetic wave. Because a majority of antennas are vertically-polarized (at least in certain frequency bands for certain applications), using a horizontally-polarized antenna can reduce the amount of interference that is effectively experienced.

Unfortunately, constructing a horizontally-polarized antenna is usually more expensive, and installing one can be more difficult because of the different factors that must be considered and ameliorated. Furthermore, conventional horizontally-polarized antennas are relatively large, unwieldy, and/or unsightly.

Historically, horizontally polarized omni-directional antennas were typically designed and achieved by incorporating several linear antennas, such as dipoles, in a configuration that generates a radiation pattern approaching equal intensity in all directions. These dipoles were configured in a plane with the radiation of each element emanating outward from the center of the cluster. The radiation patterns of the individual dipoles in a plane containing the elements have half-power beam widths of approximately 78°. Because of this, the sum of the individual dipole patterns may have dips at the crossover of adjacent patterns. For example, a four-element cluster will have dips, which are greater than 3 dB, in the pattern every 45°.

To overcome the problem of dips in the radiation patterns, additional antennas are employed. As more dipole antennas are incorporated, the diameter of the array increases to accommodate the additional dipole length along the circumference of the circle encompassing the array cluster. Thus, this increase in the structural size of a traditional omni-directional antenna, albeit in a plane that can be fairly thin, poses a mechanical design problem. The mechanical design problem is further exacerbated when this antenna design is used for some applications, such as vehicle mounted mobile applications.

When mounted on a vehicle, an omni-directional horizontally-polarized antenna may be mounted such that it is elevated at a minimum of $2\lambda$, with $\lambda$ representing the wavelength of the electromagnetic wave of interest, above the metallic surface of the vehicle to achieve a low angle toward-the-horizon signal detection due to the potential interference caused by the roof of the vehicle. The aerodynamic design for minimum wind deflection is challenging, in addition to preventing the antenna from being torn off or irreparably damaged by objects hitting it or snagging it while the vehicle is in motion. The disk, which results from the circle of the array cluster of a traditional horizontally polarized antenna, on top of an antenna mast can be obtrusive, especially when the structure is "beefed-up" to meet given mechanical specifications and to hold-up under the conditions associated with vehicle travel.

In contrast, certain example embodiments of the invention as illustrated in the associated figures and as described herein at least partially address one or more of the deficiencies of traditional approaches. By way of example only, a horizontally-polarized antenna that transceives omnidirectionally may be fabricated efficiently in accordance with certain example embodiment(s). As another example, a horizontally-polarized antenna that transceives omnidirectionally may be constructed in accordance with certain example embodiment(s) so as to mimic the traditional size, shape, and/or visual appearance of a conventional vertically-polarized antenna. As a further example, a slot aperture tubular antenna with a 3-D cross-section that can omni-directionally transceive a horizontally-polarized electromagnetic signal is described. Other general and specific example embodiments are described herein below.

Example Embodiments

FIG. 1 depicts an example of a horizontally-polarized omni-directional antenna 100 that includes an antenna assembly 102 to transceive electromagnetic signals with a horizontal polarization. As illustrated, antenna 100 includes antenna assembly 102, an elevating member 104, a radome 106, and an aesthetic member 108.

In an example embodiment, a top end of elevating member 104 is adjacent to a bottom end of radome 106, and a top end of radome 106 is adjacent to a bottom end of aesthetic member 108. Radome 106 at least partially surrounds antenna assembly 102. Although not so illustrated in FIG. 1, radome 106 may only partially enclose antenna assembly 102. For example, radome 106 may cover the top and sides of antenna assembly 102 and be mounted directly to a surface that is not electrically-conductive (e.g., fiberglass, etc.), even without an elevating member 104. Thus, radome 106 may be adapted to be connected directly to a mounting apparatus. Antenna assembly 102 is described further herein below.

From a structural perspective, the top end of elevating member 104 may be connected to a bottom end of antenna assembly 102 and/or of radome 106. Similarly, a bottom end of aesthetic member 108 may be connected to a top end of antenna assembly 102 and/or of radome 106.

Elevating member 104 includes a base 110 and a piping section 112. Base 110 may include at least one mounting provision. Examples of mounting provisions include, but are not limited to, a threaded connector 114, a flexible spring 116, and so forth. Threaded connector 114 may be, for example, a threaded connector that mates to a standard mounting apparatus, such as an NMO mount. A housing (not shown) may cover flexible spring 116 and/or base 114. Such a housing may be flexible, especially in the vicinity of flexible spring 116, and/or may be tapered toward piping section 112. Piping section 112 is shown as being at least approximately circular in cross section; however, it may alternatively have a different cross-sectional shape.

From an electrical perspective, a top end of elevating member 104 may be electrically coupled to a bottom end of antenna assembly 102. Elevating member 104 may be formed from, at least in part, a rigid coaxial line, a hollow tube that is adapted to accept at least one coaxial cable to create an elevated feed, and so forth. Current and power that form electromagnetic signals are propagated through elevating member 104 to antenna assembly 102, and vice versa. Radome 106 may be constructed of any dielectric material having sufficient strength and adequate low loss properties. Examples include, but are not limited to, fiberglass, plastic, rubber, and so forth.

From an aesthetic perspective, radome 106 may also enclose antenna assembly 102. Moreover, radome 106 may be fabricated such that it provides a visual appearance of an over-molded load coil. In an example embodiment, aesthetic member 108 need not contribute to the electrical or electromagnetic properties of antenna 100. (An alternative example embodiment in which the top member (or another section) of an antenna is functional is described herein below with particular reference to FIG. 12.) Instead, aesthetic member 108 enables antenna 100 to emulate the visual appearance of many vertically-polarized antennas that are relatively commonly mounted on the surface of motor vehicles. The spherical tip at the top end of aesthetic member 108 may be omitted or replaced with a different geometrical element. Also, although aesthetic member 108 is shown as being at least approximately circular in cross section, it may alternatively have a different cross-sectional shape.

Figure 2:
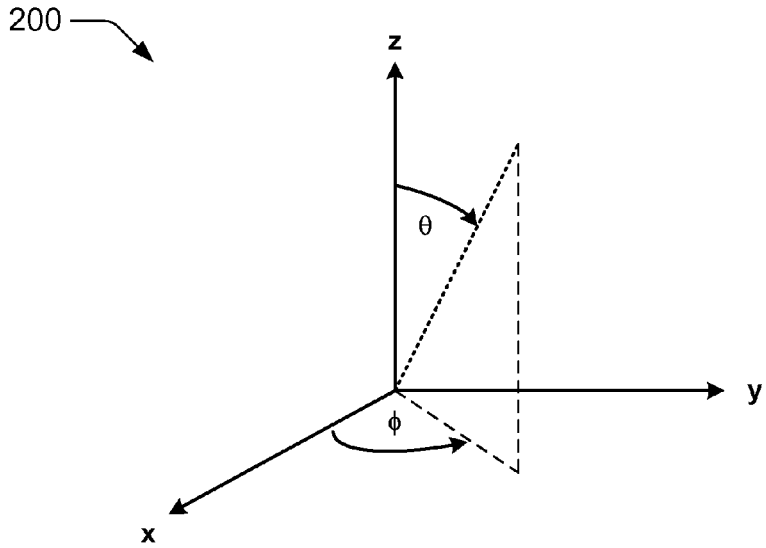
FIG. 2 illustrates an example Cartesian three-dimensional (3-D) coordinate system.

FIG. 2 illustrates an example Cartesian three-dimensional (3-D) coordinate system 200. Coordinate system 200 is used to describe electromagnetic (E) fields. Coordinate system 200 includes an x-axis, a y-axis, and a z-axis. The angle $\phi$ is defined in the x-y plane with regard to the x-axis. The angle $\theta$ is defined with regard to the z-axis. E-fields for an infinite ground plane are described by the following two equations:

$$E_\phi(\theta) = \frac{\cos[(\pi/2)\cos\theta]}{\sin\theta}$$

and $$E_\phi(\phi)=\text{constant},$$

where $E_\phi(\theta)$ is the tangential electric field in the angular $\phi$ direction as a function of angle $\theta$. Further, $E_\phi(\phi)$ is the tangential field in the angular $\phi$ direction as a function of the azimuth angle $\phi$ and is constant for any value of $\theta$. However, if a slot is created in a finite ground plane, $E_\phi(\phi)$ is no longer constant. This effect is illustrated in FIG. 3.

Figure 3:
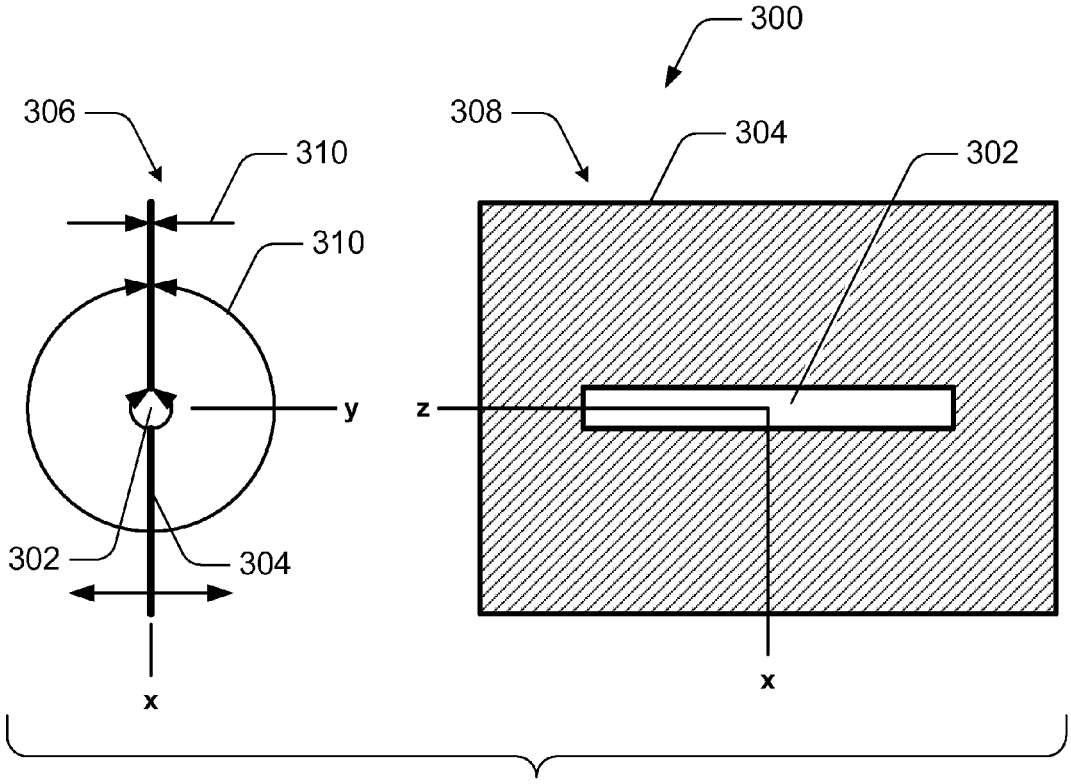
FIG. 3 illustrates an example slot aperture antenna element from two different views, with the slot aperture antenna element having a relatively 2-D (e.g., linear) cross-section.

FIG. 3 illustrates an example slot aperture antenna element 300 from two different views, with the slot aperture antenna element 300 having a relatively 2-D (e.g., linear) cross-section. The x, y, and z directions are indicated. A slot 302 is created in a conducting sheet 304. Slot aperture antenna element 300 is shown in a cross-sectional view 306 and a front view 308. Cross-sectional view 306 exhibits the relatively 2-D cross-section.

For hypothetical analysis purposes, conducting sheet 304 is assumed to be infinite. Slot 302 is formed from the conducting sheet 304. When infinite, conducting sheet 304 radiates in both half spheres as shown by cross-sectional view 306. The E-field vectors 310 are horizontally polarized everywhere in space and the only component of the E-field is E.

However, no real-world conducting sheet 304 is infinite. Consequently, the E-field vectors 310 in a real-world scenario are 180° out of phase with equal amplitude in the "x" direction. This results in cancellation of the radiated field. Consequently, a null occurs that gives rise to a bidirectional figure "8" pattern in the azimuth plane. A slot aperture antenna 300 that is formed from a conducting sheet 304 that is finite is thus somewhat bidirectional instead of omni directional.

Figure 4A:
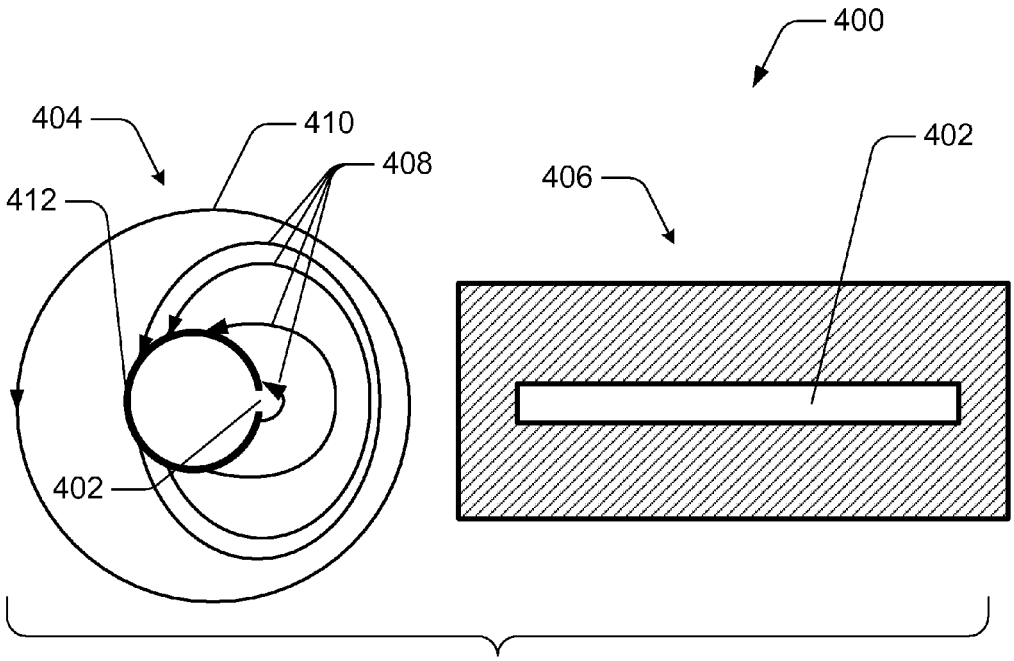
FIG. 4A illustrates an example slot aperture antenna element from two different views, with the slot aperture antenna element having a 3-D (e.g., cylindrical) cross-section.

FIG. 4A illustrates an example slot aperture antenna element 400 from two different views, with the slot aperture antenna element 400 having a 3-D (e.g., cylindrical) cross-section. A cross-sectional view 404 and a front view 406 are illustrated. Cross-sectional view 404 exhibits the 3-D cross-section. In this example, the 3-D cross-section is approximately circular.

A slot 402 is created in and defined by an electrically-conductive material. In contrast with FIG. 3, the electrically-conductive material is not a flat sheet. Instead, the electrically-conductive material is formed into a tube 412. Because tube 412 as illustrated for slot aperture antenna element 400 has a circular cross-section, tube 412 forms a cylinder.

By way of example only, tube 412 may thus be formed into a cylinder by taking a sheet and bending the edges around until they are touching and sealed to make continuity such that the E-field behavior is altered as compared to that of the flat sheet of FIG. 3. The electric vector is still horizontally-polarized, but the electromagnetic radiation is located at least primarily on the outer surface of the cylinder. As an E-field vector 408 wraps around the cylinder, it eventually separates from the conductive surface of tube 412 and closes onto itself thereby forming a circular E-field 410. The radiation pattern is therefore substantially horizontally-polarized and omni-directional in the azimuth plane, when the axis of the cylinder is collinear with the z-axis of Cartesian coordinate system 200 (of FIG. 2). In cross-sectional view 404 of FIG. 4A, the z-axis would extend perpendicularly out of the drawing. In other words, the electric field emanating from an antenna using a slot aperture antenna element 400 is horizontally polarized when the antenna is operated with its vertical axis being substantially perpendicular to a plane defined by the surface of the earth.

A specific example embodiment is described in this paragraph. A sheet is cut to a height greater than $\lambda/2$ and formed into a cylinder with the edges touching and sealed to make continuity. The cylindrical cross-section has a diameter of approximately 0.16, when constructed from sheet metal or $0.18\lambda\epsilon$-½ when constructed from copper clad laminate. It should be understood that these values are merely examples and that other embodiments using different shapes, other materials, various electromagnetic properties, etc. are described herein.

Figure 4B:
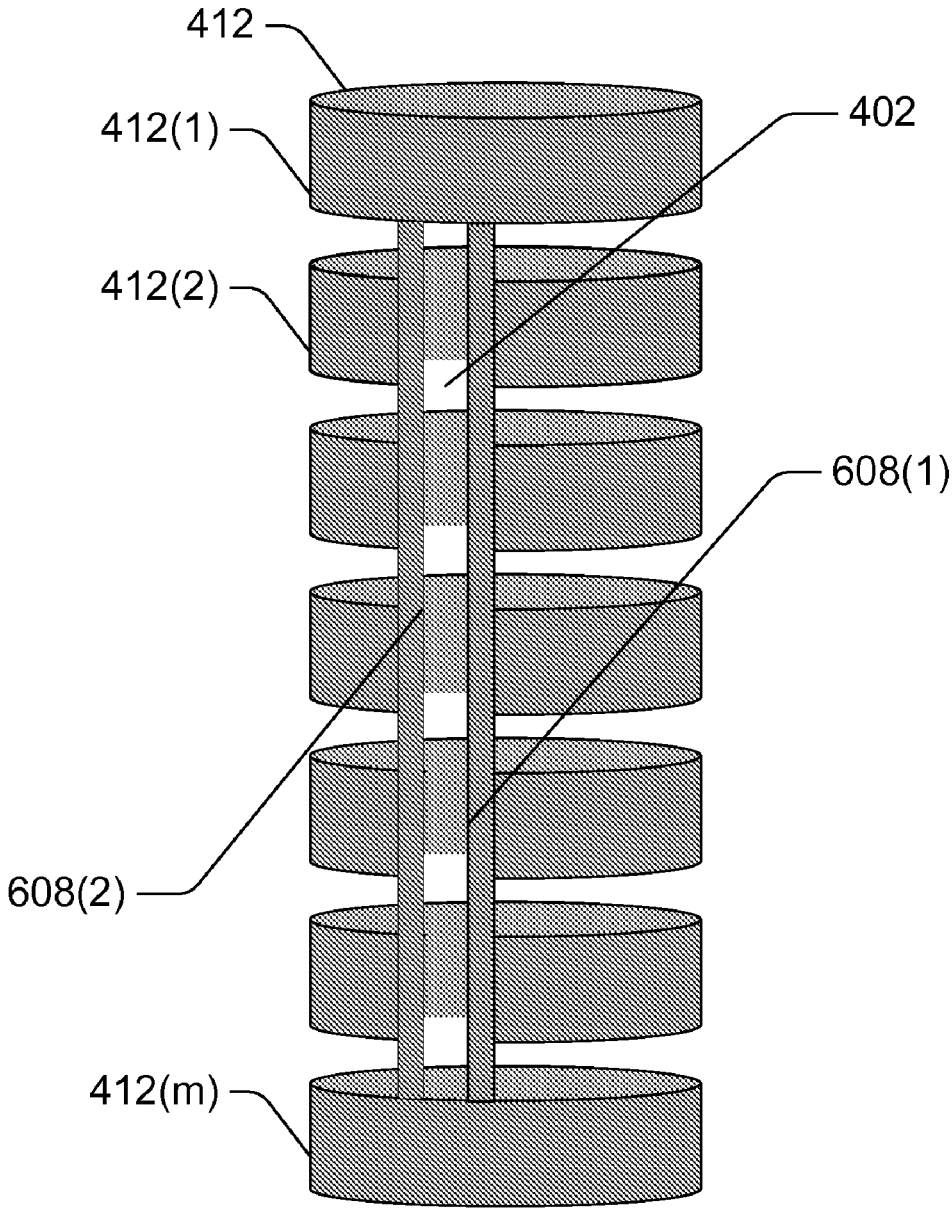
FIG. 4B illustrates an alternative embodiment for a tube having a slot for a slot aperture antenna element with a 3-D cross-section.

As an alternative embodiment, the cross-sectional shape of tube 412 may be continuous along a height of the tube or discontinuous along the height of the tube. Embodiments with an example continuous cross-sectional shape are shown in FIGS. 4A, 6, 7, 9, 11, etc. An example embodiment of a discontinuous cross-sectional shape is illustrated in FIG. 4B. The conductive element of the tube 412 (or sheet prior to being folded) can be cut perpendicular to the slot's longitudinal direction because electric currents circulate horizontally. Thus, tube 412 can be formed from a stacked series of finite elements 412(1 . . . *m*), with m being an integer, that each have a given cross-sectional shape and that are each electrically insulated from one other except at slot 402. Electrical coupling locations 608(1) and 608(2) of slot 402 are also indicated. Electrical coupling locations 608 can create the coupling via soldering, inductance, capacitance, and so forth.

Figure 5:
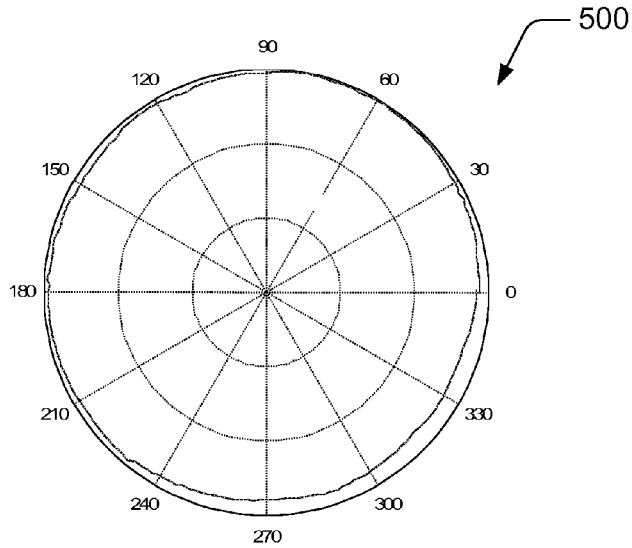
FIG. 5 is a graph that illustrates a polar plot of example radiation/azimuth patterns.

FIG. 5 is a graph 500 that illustrates a typical polar plot of example radiation/azimuth patterns. Such patterns may be produced with a horizontally-polarized omni-directional antenna having a slot aperture antenna element 400 (of FIG. 4A). The information to be wirelessly communicated may be fed to slot aperture antenna element 400 using a transmission line diposed on a supporting structure. An example embodiment of such a feeding mechanism is described below, including with reference to FIG. 6.

Figure 6:
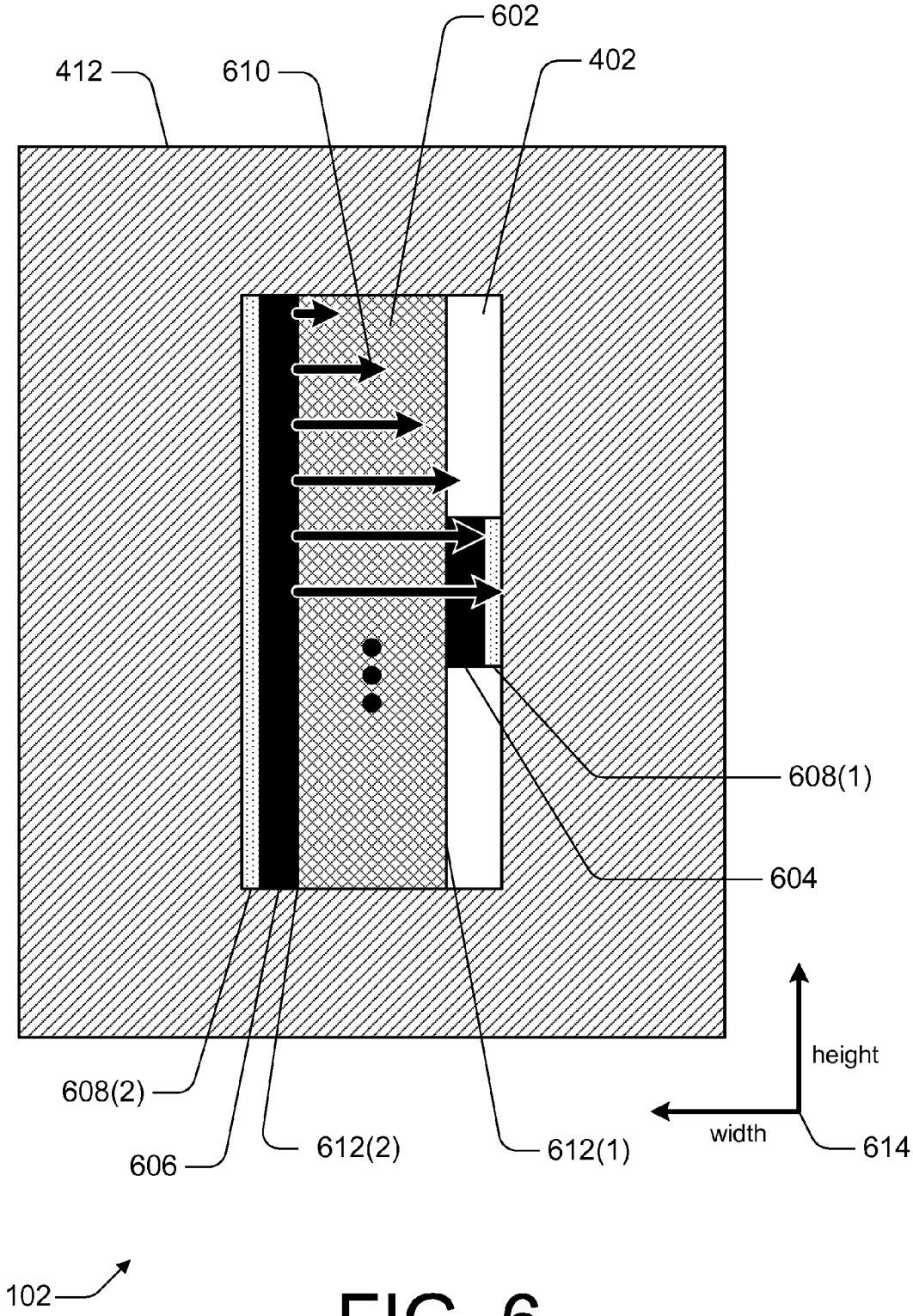
FIG. 6 is a front view of an example slot aperture antenna assembly that includes a tube and a supporting structure.

FIG. 6 is a front view of an example slot aperture antenna assembly 112 that includes a tube 412 and a supporting structure 602. As illustrated, antenna assembly 102 includes tube 412, slot 402, supporting structure 602, one or more transmission lines 604, at least one ground 606, and one or more soldering locations 608. (As described further herein, these locations may be more generally termed electrical coupling locations 608.) FIG. 6 also illustrates an electric field 610 that is generated across slot 402. Supporting structure 602 is located, at least partially, within tube 412. Antenna assembly 102 is oriented vertically in FIG. 6 as it would be for a horizontally-polarized omni-directional operation. The directions of height and width dimensions are indicated by arrows 614.

In an example embodiment, an electrically-conductive transmission line 604 is disposed on a first face 612(1) of supporting structure 602, and an electrically-conductive ground 606 is disposed on a second face 612(2) of supporting structure 602. First and second faces 612 of supporting structure 602 may be flat, curved, planar, some combination thereof, and so forth. Each layer of a multi-layer supporting structure 602, such as a typical printed circuit board (PCB), may be considered to be a face. Thus, an internal layer of a PCB or other supporting structure 602 may be face on which a transmission line 604, a ground 606, etc. is disposed.

Transmission line 604 is electrically-coupled to a first side of slot 402 at first soldering location 608(1), and ground 606 is electrically-coupled to a second side of slot 402 at second soldering location 608(2). Thus, ground 606 may be soldered 608(2) along one wall of slot 402, and transmission line 604 may be soldered 608(1) to the opposite wall of slot 402.

Signals that are applied to transmission line 604 induce or generate electric field 610, as indicated by the heavy arrows. More specifically, a modulated signal that is to be (i) transmitted or (ii) received via an antenna (i) is transformed from an oscillating electric current of transmission line 604 into electric field 610 that is present across slot 402 of tube 412 between transmission line 604 and ground 606 or (ii) is transformed from electric field 610 that is present across slot 402 of tube 412 between transmission line 604 and ground 606 into an oscillating electric current of transmission line 604, respectively. Only the top half of electric field 610 is illustrated for clarity. As shown, the strength of electric field 610 is greatest near the vertical center of the slot.

Figure 7:
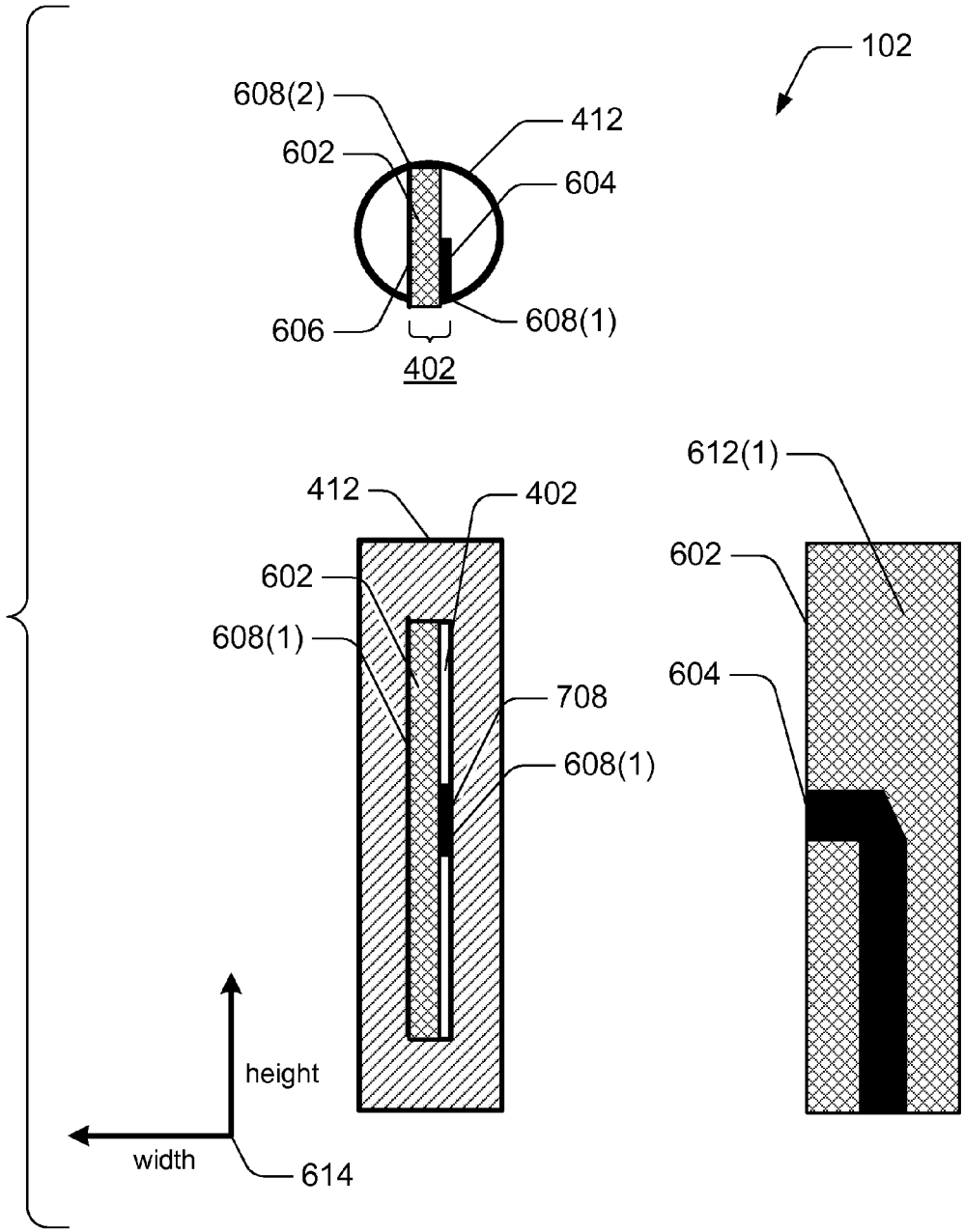
FIG. 7 illustrates an example of a slot aperture antenna assembly from different views in which a transmission line that is disposed on a supporting structure is used to induce an electric field across the slot.

FIG. 7 illustrates an example of a slot aperture antenna assembly 102 from different views in which transmission line 604 that is disposed on supporting structure 602 is used to induce an electric field across slot 402. As illustrated in the top cross-sectional view, the cross-section of tube 412 is substantially circular. The cross-section is taken along slot 402 in the vicinity of transmission line 604. Transmission line 604 and ground 606 are shown disposed on opposite faces of supporting structure 602. Soldering locations 608(1) and 608 (2) are also indicated.

The lower front view illustrates tube 412 and slot 402 in a substantially-vertical orientation. In an example embodiment, supporting structure 602 extends substantially the entire height (as defined by arrows 614) of slot 402. However, an electric field can be generated with a supporting structure 602 having a lesser height. A first face 612(1) of supporting structure 602 is also illustrated. An example pattern for transmission line 604 on supporting structure 602 is shown on first face 612(1). However, transmission line 604 may be formed into different patterns.

Tube 412 may be made from any electrically-conductive material, such as metal. Examples include, but are not limited to, copper, brass, and so forth. Tube 412 may also be formed from a flexible extension of supporting structure 602 that includes an electrically-conductive material. The flexible extension of supporting structure 602 can then be wrapped around what becomes at least a partially-surrounded portion of supporting structure 602 into some cross-sectional shape. A radome, by way of example only, may at least partially surround the wrapped flexible portion of supporting structure 602 to maintain a desired cross-sectional size and/or shape.

Regardless of the material or cross-sectional shape of tube 412, tube 412 has an internal surface and an external surface with the tube forming an internal cavity that is exposed to the internal surface as shown in the cross-sectional view. The electric field emanates from the external surface. Slot 402 that is formed from tube 412 extends from the internal surface to the external surface. Supporting structure 602 is disposed at least partly within the internal cavity of tube 412. Supporting structure 602 is positioned sufficiently proximate to slot 402 of tube 412 such that transmission line 604 (and ground 606) and slot 402 are electrically coupled. The electrical coupling between transmission line 604 and slot 402 may be accomplished via a soldering contact, an inductive coupling, a capacitive coupling, and so forth. With a capacitive coupling, for example, there need be no physical contact between (i) either or both of transmission line 604 or ground 606 and (ii) tube 412 at slot 402.

Supporting structure 602 may be rigid, flexible, and/or a combination of rigid and flexible (which is sometimes termed rigid-flex). Supporting structure 602 may be, by way of example only, a printed circuit board (PCB), a standoff (e.g., which can suspend a transmission line away from the tube), some combination thereof, and so forth. In an example embodiment, supporting structure 602 is fabricated with a material having a controllable dielectric constant. Supporting structure 602 may be made of any of a number of materials. Examples include, but are not limited to, fiber glass, TEFLON, mylar, ceramic, alumina, polyimide, another substance in which the dielectric constant may be controlled, and so forth. The width (having an orientation that is defined by arrows 614) of supporting structure 602 may be set responsive to its dielectric constant and an impedance of slot 402. The width of its dielectric substrate may also be set so as to provide structural rigidity to antenna assembly 102 by supporting a shape of tube 412. For example, 0.06 inch-thick supporting structures can provide increased strength.

The height and width dimensions of slot 402 may be set responsive to, e.g., a wavelength of interest for the antenna. By way of example only, the height of slot 402 may be set responsive to a wavelength of electromagnetic signals being transceived, with the wavelength reflecting the affects of the dielectric constant of supporting structure 602. For instance, the height of slot 402 may be set to be approximately equal to half of the wavelength.

Although slot 402 is shown as being closed at both ends, it may be formed from tube 412 in alternative manners. For example, one end may be closed, and the other end may be open. Moreover, both ends of slot 402 may be opened if at least one end of tube 412 is otherwise shorted. This shorting may be accomplished using a wire, a through via in supporting structure 602, and so forth. A supporting structure 602 having a through via is described further herein below with particular reference to FIG. 10.

The height (as defined by arrows 614) of transmission line 604 may be set responsive to an impedance of slot 402. Increasing the height of transmission line 604 lowers its impedance, but matching the impedance of transmission line 604 to the impedance of slot 402 can facilitate power transfer. Although only a single transmission line 604 at slot 402 is shown in FIGS. 6 and 7, there may alternatively be two or more such transmission lines 604. An example of two transmission lines 604 at slot 402 is described herein below with particular reference to FIG. 10.

Transmission line 604 and ground 606 may be formed from any electrically-conductive material. By way of example only, a metal such as copper may be used. Transmission line 604 may be, by way of example only, a microstrip line, a strip line, a twin line, a co-planar waveguide, some combination thereof, and so forth. Examples of ground 606 include, but are not limited to, a ground plane, a matching line for a twin line, a corresponding guide line for a co-planar waveguide, some combination thereof, and so forth.

Figure 8A:
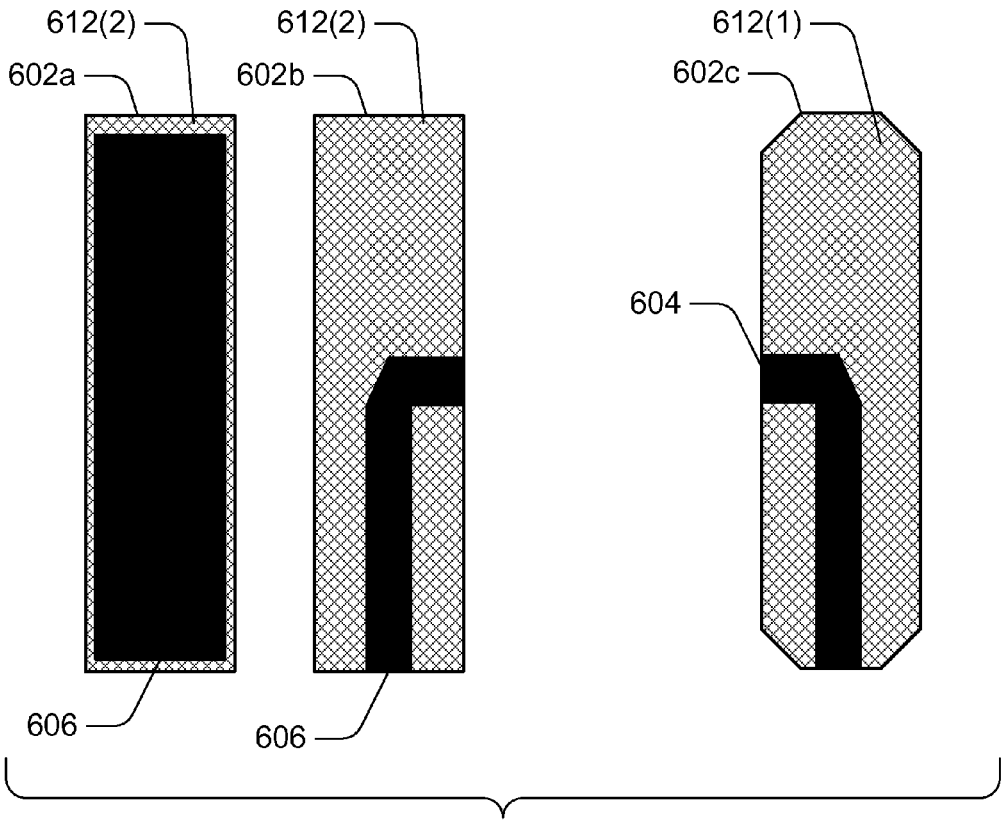
FIGS. 8A and 8B illustrate different example alternative embodiments of a slot aperture antenna having a 3-D cross section.
Figure 8B:
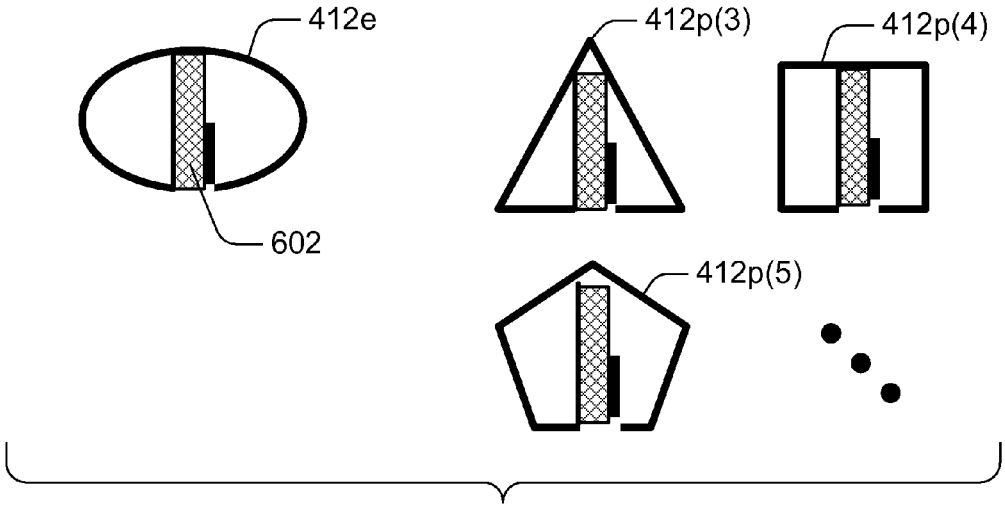

FIGS. 8A and 8B illustrate different example alternative embodiments of a slot aperture antenna having a 3-D cross section. FIG. 8A illustrates different example embodiments for supporting structure 602, and FIG. 8B illustrates different example cross-sectional embodiments for tube 412.

At FIG. 8A, supporting structures 602*a* and 602*b* show second faces 612(2) having different patterns for ground 606. Second face 612(2) of supporting structure 602*a* includes a ground 606 that is implemented as a ground plane. Second face 612(2) of supporting structure 602*b* includes a ground 606 that is implemented as matching line for a twin line. It matches a transmission line 604 of a first face 612(1) as shown in supporting structure 602*c*. Supporting structure 602*c* illustrates an example alternative shape having "shaved" corners to facilitate insertion of a supporting structure 602 into a tube 412.

Supporting structure 602 may also be formed/cut/etc. into other shapes. By way of example only, it may be cut so that an outward jutting "tooth" is created in it around the tip of transmission line 604 such that transmission line 604 can at least partially protrude into slot 402. Thus, supporting structure 602 may protrude from the internal cavity of tube 412 at least partly into slot 402. In this configuration, at least ground 606 that is disposed on supporting structure 602 may be soldered to slot 402 of tube 412.

It should be noted that ground 606 can be located at least partially on the first face 612(1) that includes transmission line 604. For example, with a co-planar waveguide, the ground tracks the central signal of the transmission line to help guide the wave. Nevertheless, ground 606 is also disposed at least partially on the opposing second face 612(2) at least near slot 402 to establish the electric field. With a co-planar waveguide implementation of transmission line 604 for example, the wave guidelines of ground 606 may be routed from first face 612(1) to second face 612(2) using one or more through vias (e.g., at or near the slot).

At FIG. 8B, multiple example alternative shapes for the cross-section of tube 412 are shown. The cross-sectional shape of tube 412 in FIG. 7 is substantially circular. In FIG. 8B, the cross-sectional shape of tube 412*e* is substantially ellipsoidal. The cross-sectional shapes of tubes 412*p* are polygonal. Example polygonal shapes include triangular (at 412*p*(3)), rectangular (e.g. square) (at 412*p*(4)), pentagonal (at 412*p*(5)), hexagonal, heptagonal, octagonal, and so forth. The cross-section of tube 412 may also be formed into other alternative shapes.

As shown by the cross-sectional views of FIG. 8B, the distal side (that is away from the slot) of supporting structure 602 may be merely near or may actually be physically in contact with the internal surface of tube 412. The supporting structure can thus be considered to have a proximal side (that is near the slot) and a distal side, with the proximal side including the transmission line. The proximal side of supporting structure 602 is positioned sufficiently proximate to the slot of tube 412 such that the transmission line and the slot are electrically coupled, and the distal side of supporting structure 602 extends toward the internal surface of tube 412 that is opposite the slot of the tube. If in contact with the internal back wall opposite the slot opening, ground 606 may be soldered thereat to tube 412. Regardless of the cross-sectional shape, placing end caps on tube 412 and soldering them in place can seal the top and bottom ends of tube 412 to prevent extraneous energy inside from interfering with the radiation pattern.

Figure 9:
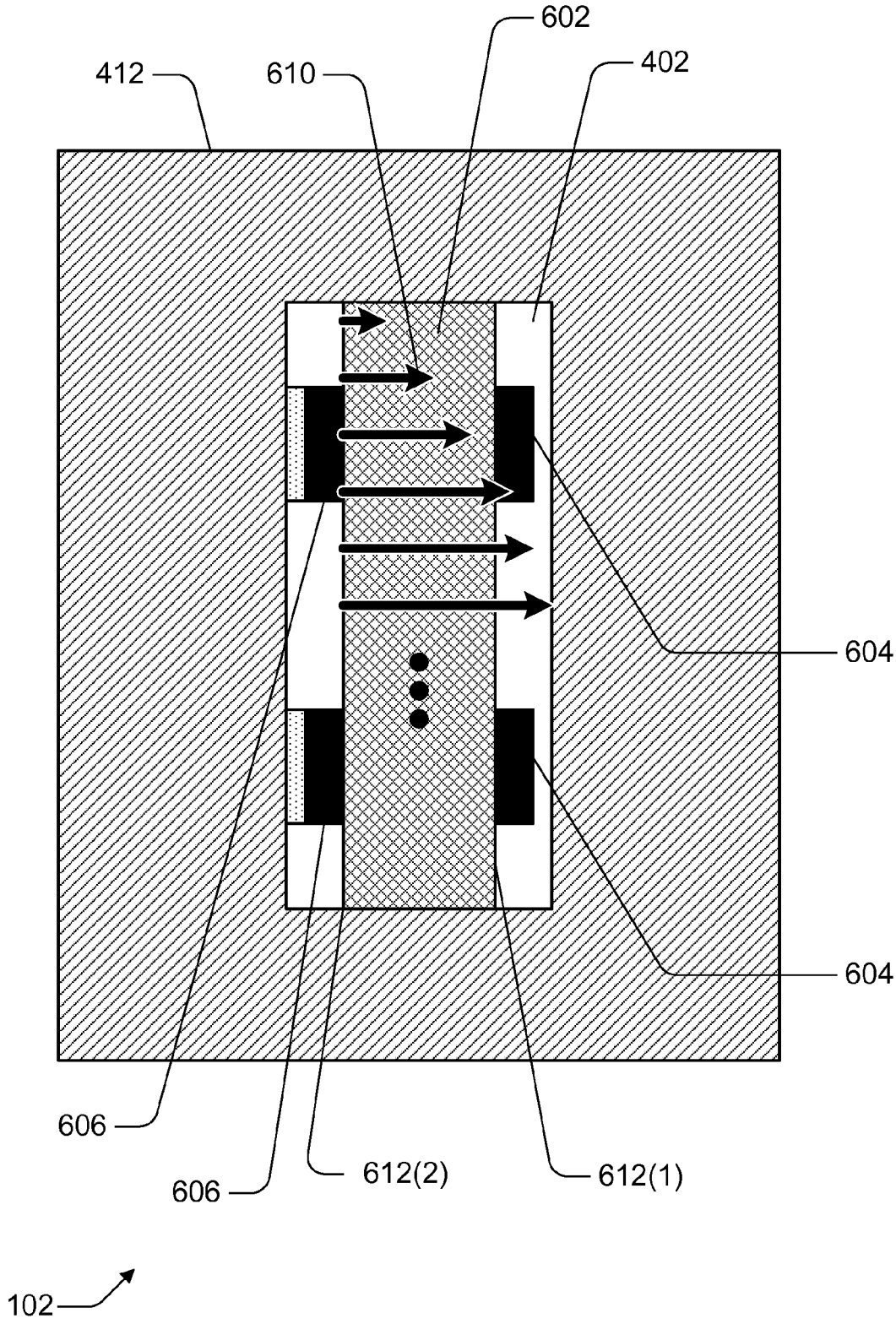
FIG. 9 is a front view of another example slot aperture antenna embodiment, in which a supporting structure includes two transmission lines to induce an electric field across the slot.

FIG. 9 is a front view of another example slot aperture antenna embodiment, in which a supporting structure 602 includes two transmission lines 604 to induce an electric field 610 across slot 402 of tube 412. The example embodiment of antenna assembly 102 that is illustrated in FIG. 9 shows additional alternatives. First, two transmission lines 604 are disposed on supporting structure 602 to induce electric field 610 across slot 402. An example pattern for two transmission lines 604 is shown in FIG. 10 and described herein below.

Second, transmission lines 604 are not soldered to the wall of slot 402. Instead, signals are transferred from transmission lines 604 to slot 402 using a capacitive coupling embodiment. Thus, transmission lines 604 are positioned sufficiently proximate to slot 402 of tube 412 so that they are electrically coupled. Although not so illustrated in FIG. 9, ground 606 may be capacitively (or inductively) coupled to the opposing wall of slot 402. Third, ground 606 is implemented as a twin line embodiment. Thus, ground 606 forms matching lines for the twin line embodiment of transmission lines 604 that is shown in FIG. 9.

Figure 10:
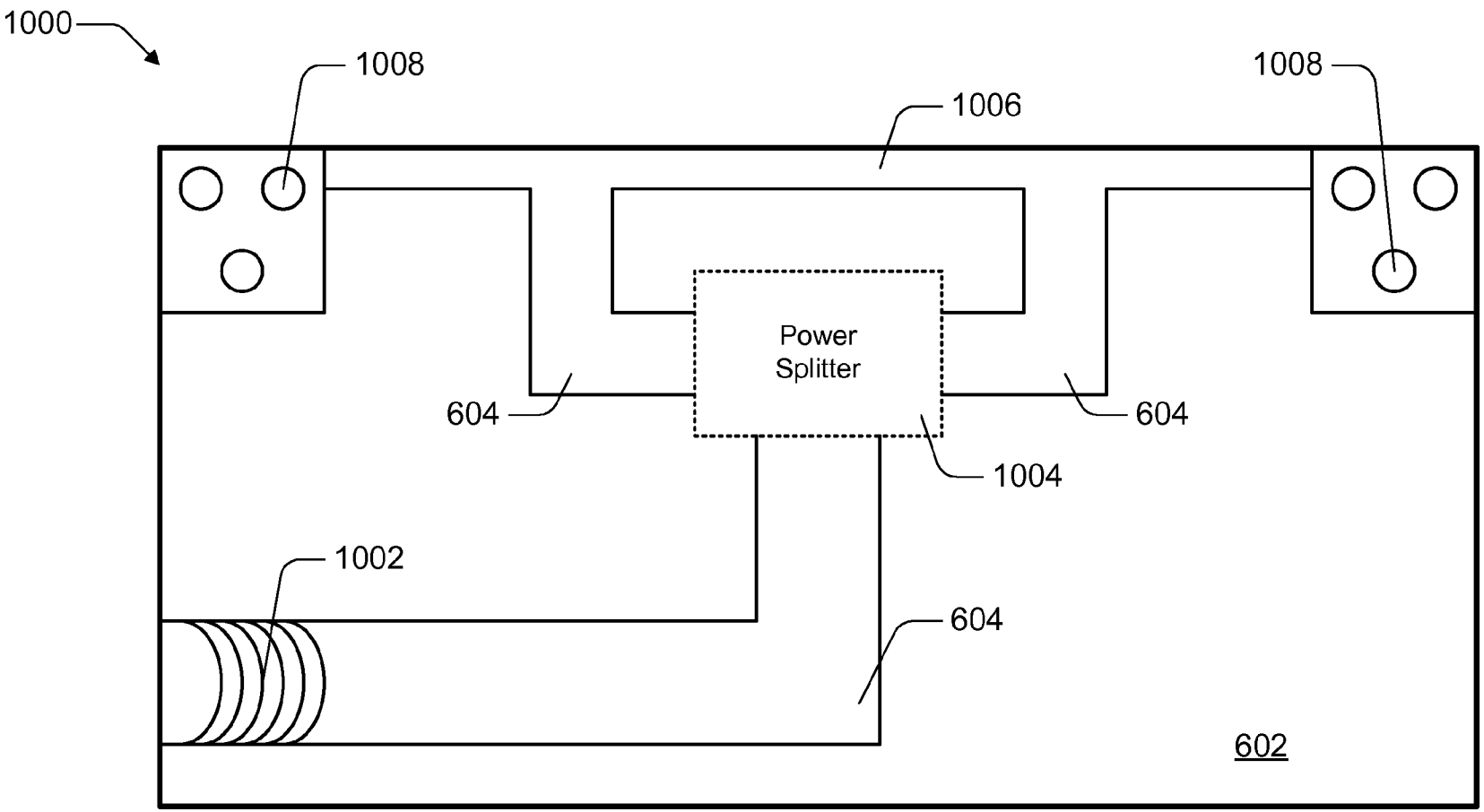
FIG. 10 depicts a supporting structure having different example alternative aspects for other embodiments of a slot aperture antenna.

FIG. 10 depicts a supporting structure 602 having different example alternative aspects for other embodiments of a slot aperture antenna. Supporting structure 602 of FIG. 10 includes a coaxial connector 1002, at least one power splitter 1004, a strip of electrically-conducting material 1006, one or more through vias 1008, and transmission lines 604.

Coaxial connector 1002 is adapted to connect to a coaxial wire, cable, etc. For example, coaxial connector 1002 may have and/or be mated to an inner conductor and an outer conductor. Transmission line 604 initially runs vertically (when in a horizontally-polarized operational orientation) along the first face of supporting structure 602 from the bottom end of the supporting structure 602 toward a slot of the tube. Transmission line 604 may be electrically coupled to the inner conductor of coaxial connector 1002, and ground 606 (not shown in FIG. 10) is electrically coupled to the outer conductor of the coaxial connector 1002.

Power splitter 1004 is disposed on at least one of the faces of supporting structure 602. It may be located on the first face with transmission lines 604 or on the second face (e.g., using through vias for inter-face coupling). As illustrated, power splitter 1004 splits the power from one transmission line 604 to two transmission lines 604. However, a single transmission line 604 may be split into three, four, or more transmission lines 604 using one or more power splitters 1004. Hence, power splitter 1004 may be a two-way, three-way, four-way . . . n-way (where n is an integer) power splitter.

In operation, power splitter 1004 splits the power of a modulated signal between a first transmission line (e.g., the one on the left) and a second transmission line (e.g., the one on the right). Power splitter 1004 may be implemented using a trace pattern on supporting structure 602 that divides power into n different transmission lines 604. Alternatively, a more complex power splitter 1004 may be implemented.

In an example embodiment, electrically-conductive strip 1006 may be applied along supporting structure 602 at least in the vicinity of slot 402. Strip 1006 can facilitate the electrical coupling between transmission line(s) 604 of supporting structure 602 and slot 402 of tube 412, especially if the wall/edge of slot 402 is relatively unsmooth.

Through vias 1008 are electrically conductive pathways from one face 612 (not explicitly indicated in FIG. 10) of supporting structure 602 to the other face of supporting structure 602. They may be formed with, for example, a metal, such as copper. As illustrated, three vias 1008 are located at each of the top and bottom ends of supporting structure 602 on the side proximate to slot 402 (not shown in FIG. 10). Vias 1008 may be used to short one or both ends of slot 402 (e.g., in lieu of and/or in addition to having an extension of tube 412 shorting the slot). Vias 1008 may alternatively be located at only one of the two ends of slot 402. Also, fewer or more than three vias 1008 may be located at each end, vias 1008 may be located in another pattern such as in a line along the slot, and so forth.

Additional vias 1008 may be used alternatively for other purposes. For example, vias 1008 may be positioned at other location(s) of supporting structure 602 than those illustrated in FIG. 10. They may also be used to establish an electrical coupling to a component, such as power splitter 1004, that is disposed on an opposite face of supporting structure 602.

Figure 11A:
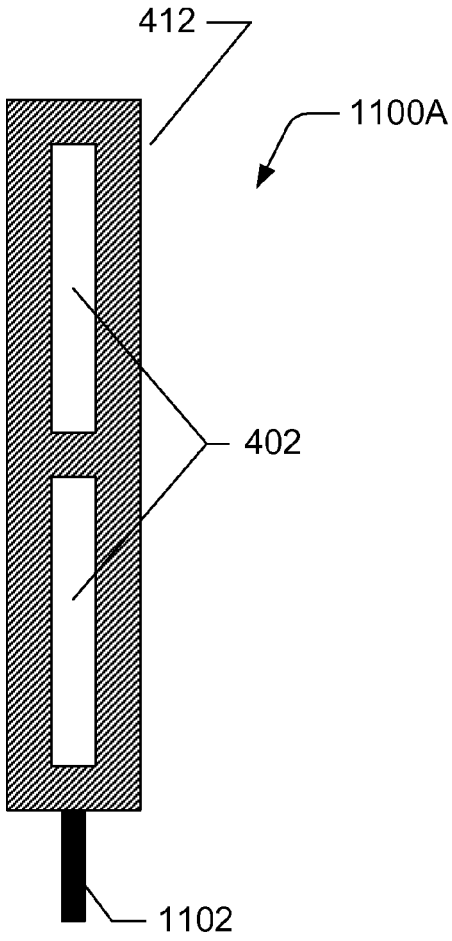
FIGS. 11A and 11B illustrate relatively high-gain example embodiments of slot aperture antennas that have multiple slots apiece to form an antenna array.
Figure 11B:
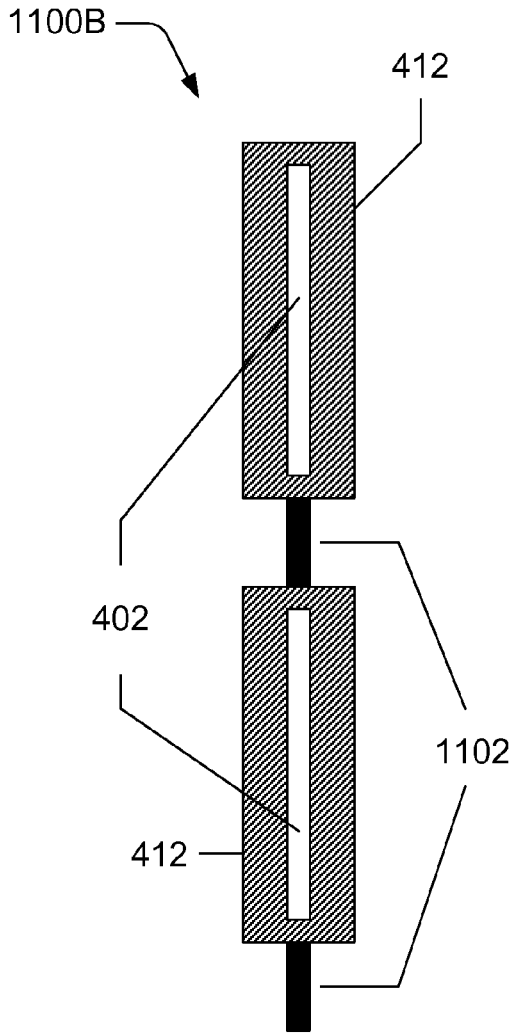

FIGS. 11A and 11B illustrate relatively high-gain example embodiments of slot aperture antennas 1100A and 1100B, respectively, that have multiple slots 402 apiece to form an antenna array. As illustrated, slot aperture antennas 1100A and 1100B include two slots 402. Slot aperture antenna 1100A includes a single tube 412 that forms two slots 402. Slot aperture antenna 1100B includes two tubes 412, each respective tube 412 forming a respective slot 402.

In an example embodiment, configuring the antenna assemblies into an array of two elements and summing their responses can increase the gain (e.g., by at least 3 dB over a single element gain). Communication signals are coupled to the antenna arrays of slot aperture antennas 1100A and 1100B using at least one signal line 1102. Signal lines 1102 may be, for example, coaxial lines, transmission lines, a combination thereof, and so forth. For instance, a coaxial line may feed the signal to the overall array while transmission line(s) are used to feed the multiple slots.

Although two slots 402 are illustrated in FIGS. 11A and 11B, three, four or more such slots 402 may be employed for each slot aperture antenna array 1100A and 1100B. With slot aperture antenna array 1100A, each of the multiple slots 402 are formed from a single tube 412. With slot aperture antenna array 1100B, each respective slot 402 is formed from a respective tube 412. However, these two embodiments may be combined. For example, a four-slot array may be formed from two two-slot aperture antenna arrays 1100A that are interconnected by a communication line 1102.

Relatively high-gain antennas may be implemented with slot aperture antenna arrays 1100A and 1100B. Although they may be employed in mobile environments, they can be employed in a fixed scenario in which the angle of the antenna may be established by the fixed installation. Especially in such a fixed installation, the slot aperture antenna arrays 1100A and 1100B may be fully or partially surrounded by a radome of a single cross-sectional shape. By way of example only, the cross-sectional shape of the radome may match the cross sectional shape of the tubes 412 from which the arrays are constructed. For instance, a cylindrical radome may partially or fully surround a slot aperture antenna array with or without an elevating member 104 and/or an aesthetic member 108.

Although none are explicitly illustrated in FIGS. 11A and 11B, supporting structure 602 may be used in conjunction with tubes 412. For example, an individual respective supporting structure 602 may be used for each respective slot 402. Alternatively, one supporting structure 602 may be used for multiple slots 402. For instance, one supporting structure 602 may have four respective transmission lines 604 disposed thereon for four respective slots 402. Other combinations may be implemented.

Figure 12:
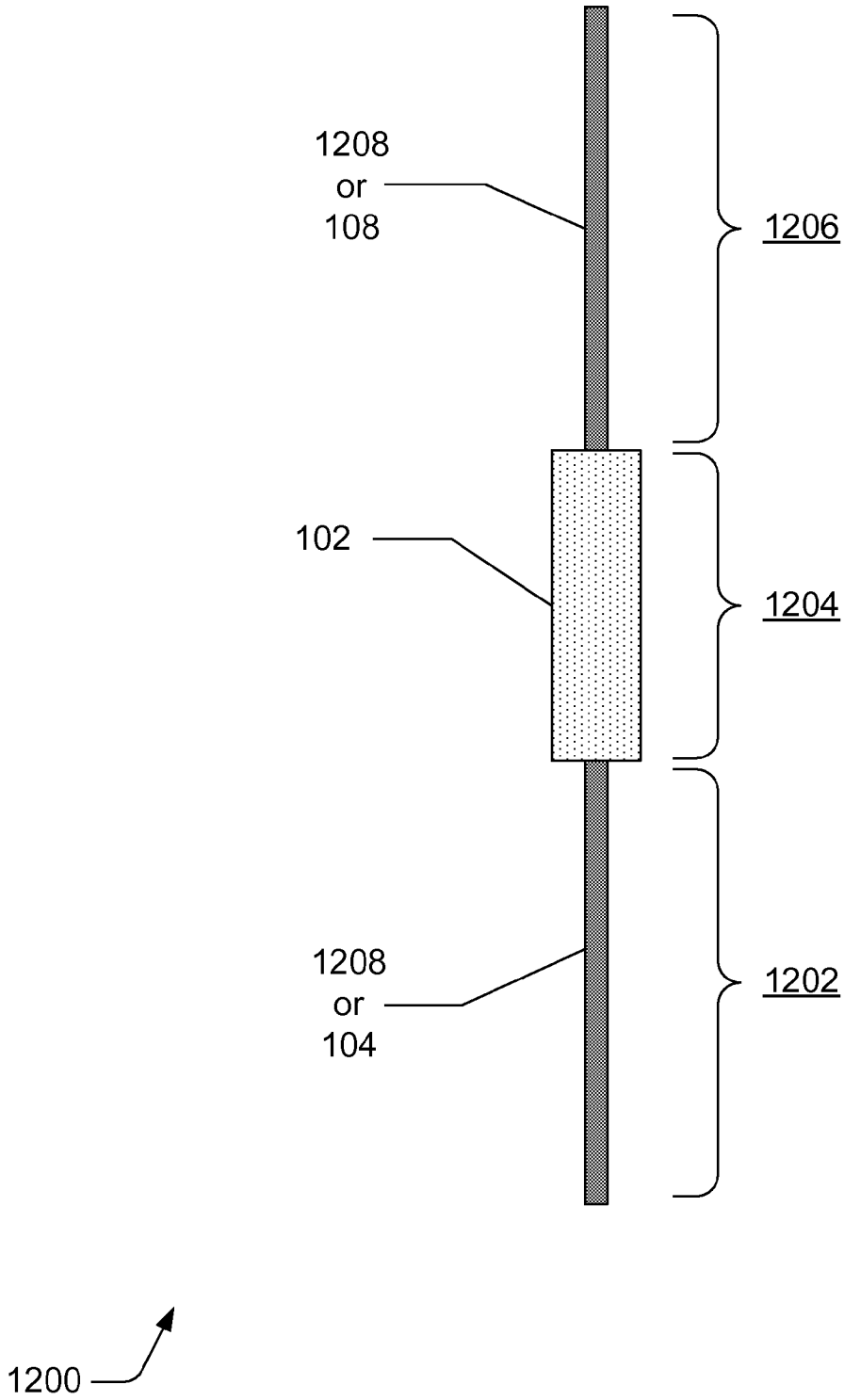
FIG. 12 illustrates an example antenna including a combination of a vertically-polarized section and a horizontally-polarized section.

FIG. 12 illustrates an example antenna 1200 including a combination of a vertically-polarized section and a horizontally-polarized section. As illustrated, antenna 1200 includes a first section 1202, a second section 1204, and a third section 1206. Second section 1204 is shown as being connected between first and third sections 1202 and 1206; however, first, second, and third sections 1202, 1204, and 1206 may be arranged in alternative orders.

In an example embodiment, second section 1204 includes a horizontally-polarized antenna assembly 102. Horizontally-polarized antenna assembly 102 includes at least one slot aperture antenna having a three-dimensional cross section as described hereinabove. The horizontally-polarized antenna assembly can produce an omni-directional pattern.

First section 1202 and/or third section 1206 may be non-functional or functional extension members. If non-functional, either or both sections may be used to aesthetically disguise the nature of the overall antenna 1200. If one or both of the first and third sections are functional, then they may work in conjunction with the horizontally-polarized omni-directional antenna assembly 102 of second section 1204. If both first and third sections 1202 and 1206 are functional, first and third sections 1202 and 1206 may be part of an antenna that runs the entire height of antenna 1200 for vertically-polarized communication, with second section 1204 providing a horizontally-polarized communication capability. Or, first and third sections 1202 and 1206 may be separate antennas that are each individually operable for vertically-polarized communication.

Third section 1206, if functional, may be a vertically-polarized antenna part 1208. Vertically-polarized antenna part 1208 is adapted to transceive wireless signals with a vertical polarization. Its pattern may also be omni-directional. By way of example only, vertically-polarized antenna part 1208 may be a vertical whip antenna. On the other hand, if third section 1206 is nonfunctional, it may be an aesthetic member 108 (of FIG. 1). Similarly, first section 1202, if non-functional, may be an elevating member 104. If functional, first section 1202 may be a vertically-polarized antenna part 1208.

In an example embodiment, third section 1206 is functional as a vertically-polarized antenna part 1208. Vertically-polarized antenna part 1208 and horizontally-polarized antenna assembly 102 may receive the same signal. For example, if first section 1202 is non-functional, it may include one or more feed lines for an electromagnetic signal. Horizontally-polarized antenna assembly 102 and vertically-polarized antenna part 1208 are fed the electromagnetic signal by at least one of (i) a single feed line that is divided using a power splitter or (ii) respective independent feed lines. The feed lines may be integrated with and/or capable of being inserted into an elevating member 104 implementation of first section 1202.

The antennas, apparatuses, acts, aspects, features, functions, structures, parts, components, etc. of FIGS. 1-12 are illustrated in diagrams that are divided into multiple blocks, components, and other elements. However, the order, interconnections, interrelationships, layout, etc. in which FIGS. 1-12 are described and/or shown are not intended to be construed as a limitation, and any number of the blocks, components, and/or other elements can be modified, combined, rearranged, augmented, omitted, etc. in any manner to implement one or more antennas, systems, apparatuses, methods, devices, arrangements, etc. for horizontally-polarized omni-directional antennas.

Although antennas, systems, apparatuses, methods, devices, arrangements, mechanisms, approaches, and other example embodiments have been described in language specific to structural, operative, and functional features and/or diagrams, it is to be understood that the invention defined in the appended claims is not necessarily limited to the specific features or acts described above. Rather, the specific features and acts described above are disclosed as example forms of implementing the claimed invention.

What is claimed is:

1. An antenna for wireless electromagnetic communications, the antenna comprising:

a tube having an internal surface and an external surface, the tube forming an internal cavity, the tube forming a slot that extends from the internal surface to the external surface;

a supporting structure disposed at least partly within the internal cavity of the tube, the supporting structure having at least a first face and a second face;

an electrically-conductive transmission line disposed on the first face of the supporting structure, the transmission line positioned sufficiently proximate to the slot of the tube such that the transmission line and the slot are electrically coupled; and an electrically-conductive ground disposed on the second face of the supporting structure, the ground positioned sufficiently proximate to the slot of the tube such that the ground and the slot are electrically coupled.

2. The antenna as recited in claim 1, wherein the transmission line and the slot of the tube are electrically coupled to each other via at least one of a soldering contact, an inductive coupling, or a capacitive coupling.

3. The antenna as recited in claim 2, wherein the supporting structure protrudes from the internal cavity of the tube at least partly into the slot of the tube.

4. The antenna as recited in claim 1, wherein the tube has a cross-sectional shape, and the cross-sectional shape is selected from a group of cross-sectional shapes comprising: a circular shape, an elliptical shape, and a polygonal shape.

5. The antenna as recited in claim 4, wherein the cross-sectional shape is at least one of: continuous along a height of the tube or discontinuous along the height of the tube.

6. The antenna as recited in claim 1, further comprising:

a radome that at least partially surrounds the tube and the supporting structure, wherein the radome is adapted to connect directly to at least one of an elevating member or a mounting structure.

7. The antenna as recited in claim 1, wherein a height of the slot of the tube is set responsive to a wavelength of a wireless signal being transceived by the antenna.

8. The antenna as recited in claim 1, further comprising:

a second electrically-conductive transmission line disposed on a first face of the supporting structure; and a power splitter disposed on at least one of a face or an alternate face of the supporting structure, the power splitter to split power of a modulated signal at least between the transmission line and the second transmission line;

wherein a distance between the transmission line and the second transmission line is set responsive to an impedance of the slot of the tube.

9. The antenna as recited in claim 1, wherein the supporting structure has a proximal side and a distal side, the proximal side including the transmission line; and wherein the proximal side of the supporting structure is positioned sufficiently proximate to the slot of the tube such that the transmission line and the slot are electrically coupled, and the distal side of the supporting structure extends toward the internal surface of the tube that is away from the slot of the tube.

10. The antenna as recited in claim 1, wherein the supporting structure is at least one of rigid, flexible, or a combination of rigid and flexible.

11. The antenna as recited in claim 1, further comprising:

a second electrically-conductive transmission line disposed on the first face of the supporting structure; and a power splitter to split power of a modulated signal between at least the transmission line and the second transmission line;

wherein:

the tube forms a second slot that extends from the internal surface to the external surface of the tube; and the second transmission line is positioned sufficiently proximate to the second slot of the tube such that the second transmission line and the second slot are electrically coupled.

12. The antenna as recited in claim 1, further comprising:

a second tube having an internal surface and an external surface, the second tube forming an internal cavity, the second tube forming a slot that extends from the internal surface to the external surface of the second tube;

a second supporting structure disposed at least partly within the internal cavity of the second tube, the second supporting structure having at least a first face and a second face;

an electrically-conductive transmission line disposed on the first face of the second supporting structure, the transmission line of the second supporting structure positioned sufficiently proximate to the slot of the second tube such that the transmission line of the second supporting structure and the slot of the second tube are electrically coupled; and an electrically-conductive ground disposed on the second face of the second supporting structure, the ground of the second supporting structure positioned sufficiently proximate to the slot of the second tube such that the ground of the second supporting structure and the slot of the second tube are electrically coupled;

wherein the transmission line disposed on the first face of the supporting structure is electrically coupled to the transmission line disposed on the first face of the second supporting structure such that communication signals for the antenna are applied both to the transmission line disposed on the first face of the supporting structure and to the transmission line disposed on the first face of the second supporting structure.

13. The antenna as recited in claim 1, wherein the transmission line comprises at least one of a microstrip line, a strip line, a twin line, or a co-planar waveguide; and wherein the ground comprises at least one of a ground plane, a matching line for a twin line, or a corresponding guide line for a co-planar waveguide.

14. An antenna for wireless electromagnetic communications, the antenna comprising:

a tube having an internal surface and an external surface, the tube forming an internal cavity, the tube forming a slot that extends from the internal surface to the external surface;

a supporting structure disposed at least partly within the internal cavity of the tube, the supporting structure having at least a first face and a second face;

an electrically-conductive transmission line disposed on the first face of the supporting structure, the transmission line positioned sufficiently proximate to the slot of the tube such that the transmission line and the slot are electrically coupled;

an electrically-conductive ground disposed on the second face of the supporting structure, the ground positioned sufficiently proximate to the slot of the tube such that the ground and the slot are electrically coupled;

a radome that at least partially surrounds the tube and the supporting structure, the radome having a top end and a bottom end; and a support member that is coupled to at least one of the bottom end of the radome, the tube, or the supporting structure.

15. The antenna as recited in claim 14, further comprising:

an aesthetic member that is coupled to at least one of the top end of the radome, the tube, or the supporting structure;

wherein the support member includes a base, the base including at least one mounting provision.

16. The antenna as recited in claim 14, wherein an electric field emanating from the antenna is horizontally polarized when the antenna is operated with a vertical axis of the antenna being substantially perpendicular to a plane defined by the surface of the earth; the vertical axis of the antenna being parallel to a line defined by the tube, the radome, and the support member.

17. The antenna as recited in claim 14, wherein:

the radome encloses the tube and the supporting structure, and the radome provides a visual appearance of an over-molded load coil; and the support member comprises at least one of a rigid coaxial line or a hollow tube that is adapted to accept at least one coaxial cable to create an elevated feed.

18. The antenna as recited in claim 14, further comprising:

a coaxial connection having an inner conductor and an outer conductor;

wherein the transmission line runs vertically along the first face of the supporting structure from the slot of the tube toward a bottom end of the supporting structure; and wherein the transmission line is electrically coupled to the inner conductor of the coaxial connection, and the ground is electrically coupled to the outer conductor of the coaxial connection.

19. An antenna for wireless electromagnetic communications, the antenna comprising:

a first section comprising a supporting structure having at least a first face comprising an electrically-conductive transmission line and a second face comprising an electrically-conductive ground;

a second section comprising a horizontally-polarized omni-directional antenna assembly that is supported by the supporting structure, the horizontally-polarized omni-directional antenna assembly including at least one slot aperture antenna having a three-dimensional cross section; and a third section comprising a vertically-polarized antenna part;

wherein the first section and the third section are connected to the second section.

20. The antenna as recited in claim 19, further comprising an elevating member including at least one feed line for an electromagnetic signal; and wherein the horizontally-polarized omni-directional antenna assembly and the vertically-polarized antenna part are fed the electromagnetic signal by at least one of (i) a single feed line and a power splitter or (ii) two or more independent feed lines including a first independent feed line for the horizontally-polarized omni-directional antenna assembly and a second independent feed line for the vertically-polarized antenna part.

* * * * *